United States Patent [19]

Sugimoto et al.

[11] Patent Number: 4,808,094

[45] Date of Patent: Feb. 28, 1989

[54] DRIVE SYSTEM FOR THE ORBITING SCROLL OF A SCROLL TYPE FLUID COMPRESSOR

[75] Inventors: Kazuo Sugimoto; Hideyuki Gonda, both of Isesaki, Japan

[73] Assignee: Sanden Corporation, Gunma, Japan

[21] Appl. No.: 821,964

[22] Filed: Jan. 24, 1986

[30] Foreign Application Priority Data

Jan. 28, 1985 [JP] Japan ..... 60-9032[U]
Jan. 28, 1985 [JP] Japan ..... 60-9033[U]

[51] Int. Cl.[4] ..... F04C 18/04; F04C 29/00; F01C 17/06; F16D 3/00

[52] U.S. Cl. ..... 418/1; 418/55; 418/57; 418/182; 464/138

[58] Field of Search ..... 418/55, 57, 59, 182, 418/1; 74/595; 384/206, 207; 464/137, 138

[56] References Cited

U.S. PATENT DOCUMENTS

| | | | |
|---|---|---|---|
| 614,502 | 11/1898 | Richards | 464/137 |
| 1,451,608 | 4/1923 | Bell | 74/595 |
| 1,906,141 | 4/1933 | Ekelof | 418/57 |
| 1,906,142 | 4/1933 | Ekelof | 418/57 |
| 2,439,479 | 4/1948 | Mackmann | 464/138 |
| 2,650,754 | 9/1953 | Simon | 418/182 |
| 3,113,527 | 12/1963 | Kramer | 418/182 |
| 3,955,905 | 5/1976 | Frommholz et al. | 418/182 |
| 4,460,321 | 7/1984 | Terauchi | 418/57 |
| 4,464,140 | 8/1984 | Lundgren | 464/137 |

FOREIGN PATENT DOCUMENTS

| | | | |
|---|---|---|---|
| 419054 | 10/1910 | France | 464/138 |
| 58-172402 | 10/1983 | Japan | 418/55 |
| 25610 | 3/1915 | Norway | 464/138 |

*Primary Examiner*—John J. Vrablik
*Attorney, Agent, or Firm*—Banner, Birch, McKie & Beckett

[57] ABSTRACT

A scroll type compressor includes a housing, a pair of scrolls each comprising an end plate and a spiral wrap projecting from one surface of the end plate and a drive shaft supported within the housing. The drive shaft has a crank pin which is inserted into a hole formed in a bushing disposed in a tubular boss on the other end surface of the end plate. The hole in the bushing is formed so as to contact the outer surface of the crank pin at one point along the inner surface of the hole.

7 Claims, 4 Drawing Sheets

DRIVE SYSTEM FOR THE ORBITING SCROLL OF A SCROLL TYPE FLUID COMPRESSOR

TECHNICAL FIELD

This invention relates to the field of scroll type compressors, and more particularly, is directed to a scroll type type compressor having a bushing in the orbiting scroll drive mechanism.

BACKGROUND OF THE INVENTION

The underlying operating principles of a scroll type compressor are well-known in the art and many embodiments of such a compressor have been developed over the years. For example, a conventional scroll type compressor is shown in U.S. Pat. No. 801,182 issued to Creux. Such a compressor includes two scrolls each having a circular end plate and a spiroidal or involute spiral element. The scrolls are maintained angularly and radially offset so that both spiral elements interfit to make a plurality of line contacts between their spiral curved surfaces to thereby seal off and define at least one pair of fluid pockets. The relative orbital motion of the two scrolls shifts the line contacts along the spiral curved surfaces and, as a result, the volume of the fluid pockets changes. Since the volume of the fluid pockets increases or decreases dependent on the direction of the orbital motion, a scroll type fluid displacement apparatus may be used to compress, expand or pump fluids.

Another example of a conventional scroll type compressor which uses a bushing in the drive mechanism for the orbiting scroll is shown in published Japanese Patent Application No. 58-19,875. Such a compressor is similar in design to the one shown in FIG. 7 of the attached drawings.

In the compressor shown in FIG. 7, a fixed scroll 2 is fixedly disposed in compressor housing 1. Fixed scroll 2 is interfit with orbiting scroll 3 formed on an end surface of end plate 31. At least one fluid pocket is formed between fixed scroll 2 and orbiting scroll 3 as orbiting scroll 3 orbits about fixed scroll 2. A circular tubular boss 32 is formed on the other end surface of end plate 31. A diskshaped bushing 5 is rotatably disposed in boss 32 through needle bearing 6. A drive shaft 7 is rotatably supported within housing 1 through ball bearings 8 and 9. As shown in FIG. 8, eccentrically located hole 11 is formed through bushing 5 and receives crank pin 10. Crank pin 10 is attached to the inner end surface of drive shaft 7.

Thus, the rotation of drive shaft 7 is transmitted to orbiting scroll 3 through crank pin 10 and bushing 5.

Orbiting scroll 3 is prevented from rotating on its axis by a rotation preventing mechanism provided within the compressor. Therefore, as the orbiting scroll is moved while the fixed scroll remains stationary, the fluid pockets shift along the spiral curved surface of the scroll wraps, which changes the volume of the fluid pockets. However, due to the pressure of the compressor fluid, there is a tendency for the seal along the fluid pockets to become incomplete. Thus, a thrust bearing is provided for orbiting scroll 3 to help eliminate this problem.

In the above-mentioned conventional scroll apparatus, orbiting scroll 3 is supported by a thrust bearing comprising balls 12, an edge end portion of end plate 31 of orbiting scroll 3 and annular plate 31. Balls 12 serve as a rotation preventing mechanism for orbiting scroll 3 as shown in the above-mentioned publication of Japanese Patent Application No. 58-19,875.

When drive shaft 7 is rotated, orbiting scroll 3 orbits about fixed scroll 2 accordingly. Thus, fluid pockets 4 move toward the center of scrolls 2 and 3 which in turn decreases the volume of the fluid pockets, thereby compressing the fluid. The compressed fluid is forced to discharge chamber 14 through discharge hole 21 formed in end plate 22 of fixed scroll 2. The compressed fluid is discharged to the outside of housing 1 through a discharge port.

Disk-shaped bushing 5 shown in FIG. 7 is provided to insure that the fluid pockets formed by fixed scroll 2 and orbiting scroll 3 are securely sealed. Bushing 5 also eliminates any abnormal sealing of the fluid pockets due to manufacturing and assembly errors in the compressor.

As the fluid in fluid pockets 4 is compressed due to the operation of the compressor, orbiting scroll 3 is forced in both an axial and a radial direction. Since orbiting scroll 3 is supported against annular plate 13 by balls 12 at the edge end portion of end plate 31, the orbiting scroll is retrained from movement in the axial direction. Orbiting scroll 3 is not so retrained in the radial direction because the radial pressures acting on the orbiting scroll is not equal around the circumference of the scroll.

Accordingly, orbiting scroll 3 is urged in a direction which is determined by the crank angle 0′ of crank pin 10. (See for example, FIG. 9.)

As can be seen in FIGS. 7 and 8, orbiting scroll 3 is operatively connected to drive shaft 7 by crank pin 7 through hole 11 formed in bushing 5. Orbiting scroll 3 is moved on needle bearing 6 mounted on boss 32. In conventional compressors, such as shown in FIG. 7, there is little or no clearance between the above elements. Thus, orbiting scroll 3 is prevented from radial movement due to the pressure of the compressed fluid in the fluid pockets. However, since drive shaft 7 is rotatably supported by ball bearings 8 and 9, drive shaft 7 can be radially moved within the distance of the radial clearance provided by bearings 8 and 9. Since the radial force, (shown by an arrow A in FIG. 9) which operates on orbiting scroll 3 also operates on the inner end of drive shaft 7 in the same direction as the radial motion of drive shaft 7, drive shaft 7 can be forced to rotate along axis 0′; for example, rather than along normal axis 0 as shown in FIG. 9. When this occurs, a gap may be created between bushing 5 and needle bearing 6 and between crank pin 10 and bushing 5. Such a situation results in the uneven engagement of bushing 5 with needle bearing 6. Accordingly, bushing 5 can be easily damaged during operation of the compressor.

SUMMARY OF THE INVENTION

It is, therefore, the overall objective of the present invention to provide a scroll type compressor which includes means for preventing the aforementioned bushing from being moved out of its normal operating position by the pressure of the compressed fluid in the fluid pockets.

It is another object of the present invention to accomplish the above objective in an economical manner without adding manufacturing complexity to the compressor.

In an illustrative embodiment of the invention, these and other objectives are achieved by providing a bore or enlarged opening on the drive shaft end of the hole in the bushing which receives the crank pin. As the drive shaft moves radially in response to the pressure generated by the compressed fluid in the fluid pockets, the pin is permitted to follow this movement within the crank pin hole. Thus, the errant motion of the drive shaft is not transmitted to the bushing. Therefore, the bushing is not urged out of its normal operating position.

DETAILED DESCRIPTION

Figure 1:
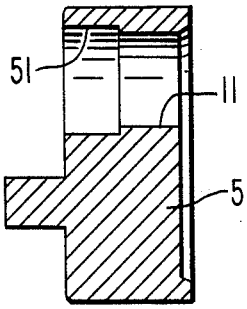
FIG. 1 is a cross-sectional view of a bushing in accordance with an embodiment of the present invention.
Figure 2:
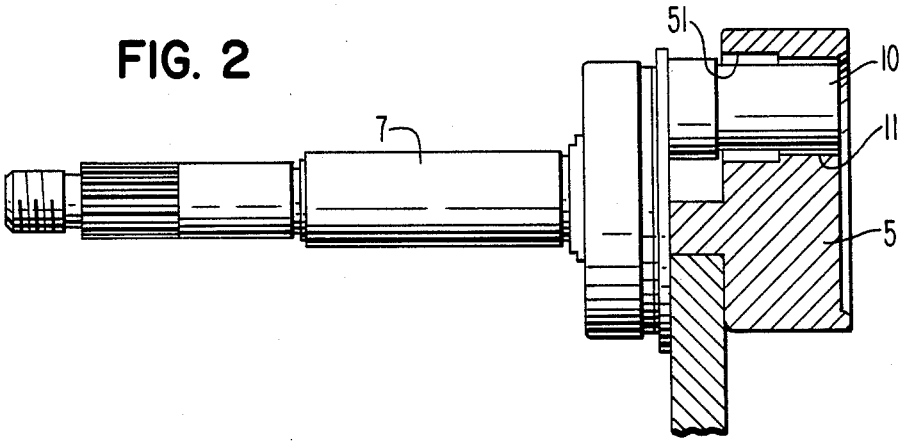
FIG. 2 is a cross-sectional view illustrating the assembly of a bushing, a crank pin and a drive shaft in accordance with the emodiment of the present invention shown in FIG. 1.
Figure 3:
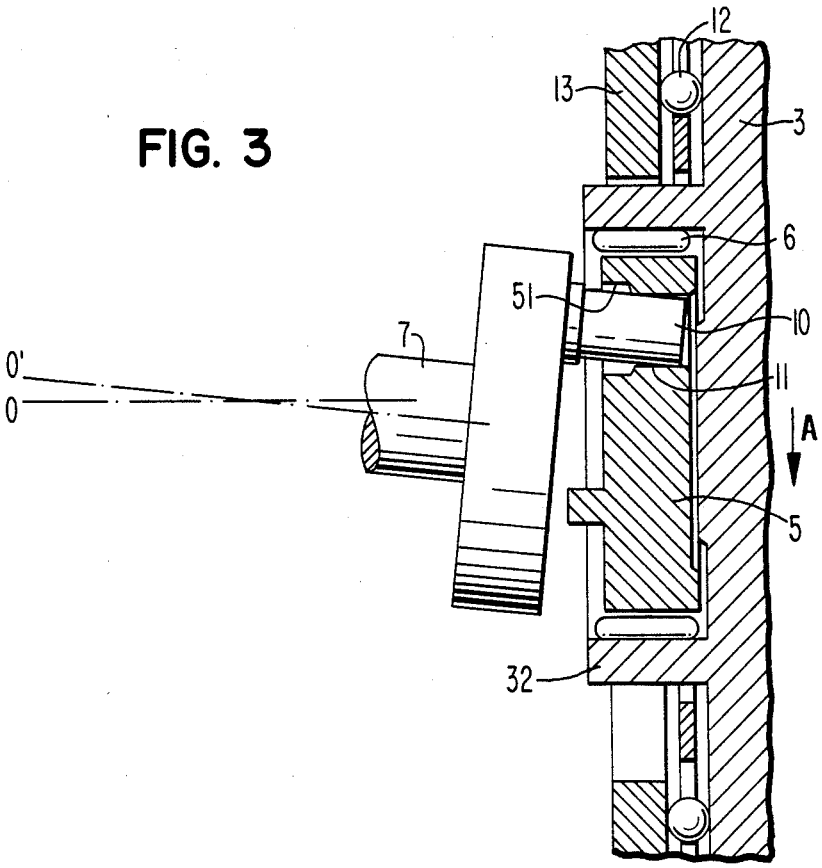
FIG. 3 is a cross-sectional view illustrating the operation of a drive shaft and a bushing in accordance with the embodiment of the present invention shown in FIG. 1.

With reference to FIGS. 1, 2 and 3, there is shown a bushing 5 which includes hole 11. Hole 11 has a bore 51 which enlarges an end portion of hole 11 as shown in FIG. 1. A crank pin 10 which drives drive shaft 7 is disposed in hole 11 through bore 51.

With bore 51 formed in hole 11 as shown in FIGS. 1, drive shaft 7 is permitted to move between angle 0 and 0′ as is shown in FIG. 3 without coming into contact with the edge of hole 11.

Figure 4:
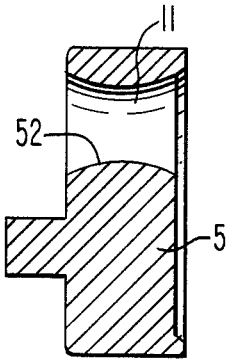
FIG. 4 is a cross-sectional view of a bushing in accordance with another embodiment of the present invention.
Figure 5:
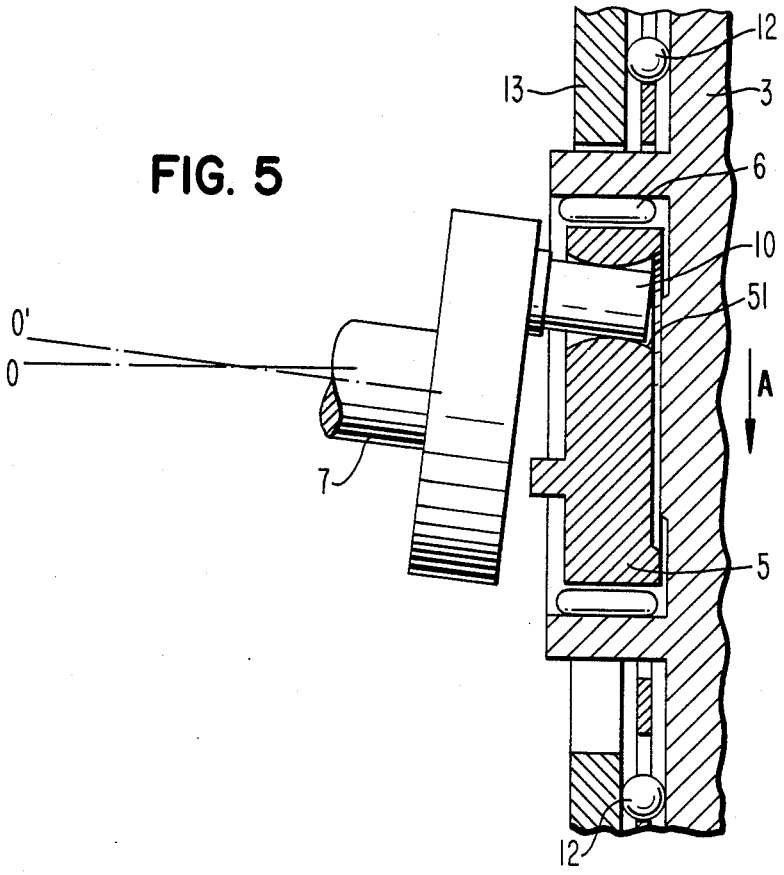
FIG. 5 is a cross-sectional view illustrating the operation of a drive shaft and a bushing in accordance with the embodiment of the present invention shown in FIG. 4.

With reference to FIGS. 4 and 5, another embodiment of the present invention is shown. In this embodiment, hole 11 is provided with inner and outer contour 52. The inner surface of hole 11 thus comes into contact with crank pin 10 only at the center portion of the hole as the hole is formed in a circular arc which curves away from crank pin 10.

With hole 11 formed in the manner shown in FIG. 4, orbiting scroll 3 is permitted to move radially as indicated by arrow A in FIG. 5 due to the radial pressure exerted by the compressed fluid. Accordingly, drive shaft 7 is permitted to move between angle 0 and 0′ since crank pin 10 is permitted to move along curved surface 52. Accordingly, the stress and strain on bushing 5 is eliminated and it is not forced out of its normal operating position. The amount of movement of shaft 7 between angle 0 and 0′ can be increased by enlarging the curvature inside hole 11.

Figure 6:
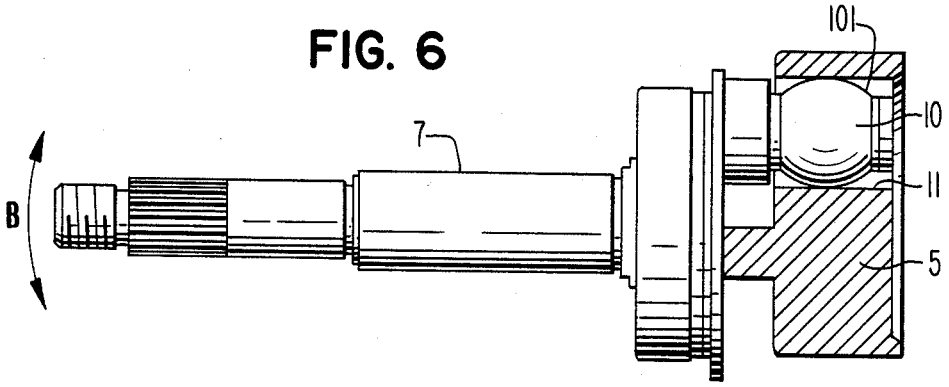
FIG. 6 is a cross-sectional view illustrating the operation of a drive shaft and a bushing in accordance with a further embodiment of the present invention.
Figure 7:
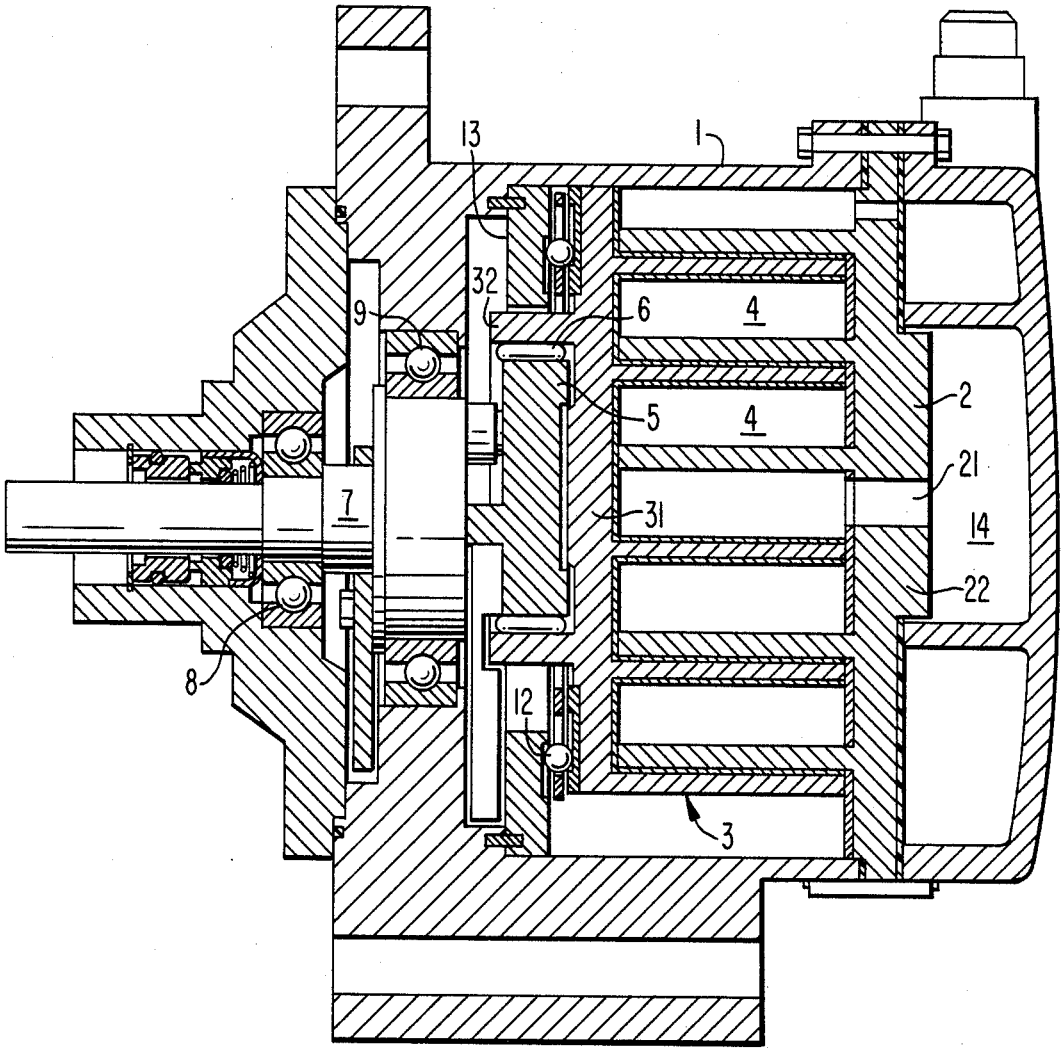
FIG. 7 PRIOR ART
FIG. 7 is a cross-sectional view of a scroll type compressor using a conventional a bushing.
Figure 8:
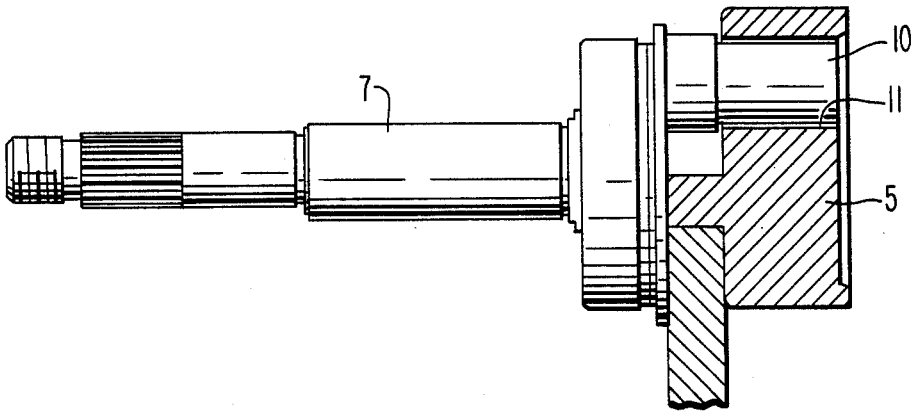
FIG. 8 PRIOR ART
FIG. 8 is a cross-sectional view illustrating the assembly of a conventional bushing, a crank pin and a drive shaft.
Figure 9:
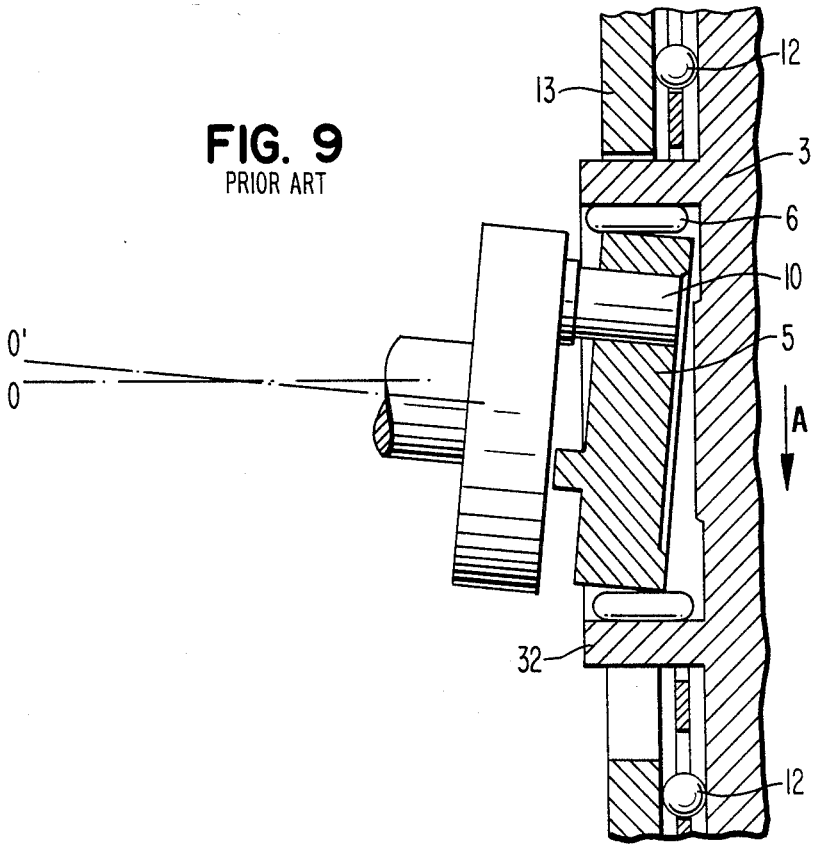
FIG. 9 PRIOR ART
FIG. 9 is a cross-sectional view illustrating the operation of a conventional bushing, drive shaft and bushing.

With reference to FIG. 6, a further embodiment of the present invention is shown. In this embodiment, the inner surface of hole 11 is not changed, however, crank pin 10 has an outwardly contoured shape 101. Thus, the outer surface of pin 10 is formed in a circular arc which curves away from the inner surface of hole 11. Therefore as drive shaft 7 moves about as shown by arrow B in FIG. 6, crank pin 10 is permitted to move accordingly within hole 11. Thus, the movement of drive shaft 7 is not transmitted to bushing 5. The amount of movement permitted by drive shaft 7 before bushing 5 will be effected can be increased by enlarging the curvature of outwardly contoured shape 101 of crank pin 10.

This invention has been described in detail in connection with preferred embodiments. However, these embodiments are examples only and the invention is not restricted thereto. It will be easily understood by those skilled in the art that other variations and modifications can be easily made within the scope of this invention.

We claim:

1. In a scroll type compressor comprising a drive shaft, a bushing and a crank pin connected therebetween said bushing having a hole therein defined by an inner surface of said bushing wherein said drive shaft is capable of tilting through a predetermined angle, a method of preventing said tilting movement of said drive shaft from being transmitted to said bushing, said method consisting essentially of modifying said crank pin by forming said crank pin with a surface that is curved away from an inner surface of said bushing.

2. In a scroll type compressor including a housing, a fixed scroll fixedly disposed within said housing and having a first circular end plate from which a first spiral wrap extends into the interior of said housing, an orbitting scroll having a second circular end plate from which a second spiral wrap extends, said first and second wraps interfitting at an angular and radial offset to form a plurality of line contacts which define at least one pair of sealed off fluid pockets, a disk shaped bushing rotatably placed in a circular tubular boss formed on a side opposite said second spiral wrap of said orbiting scroll and having a hole defined by an inner surface of said bushing, a drive shaft supported within said housing through a bearing, and a crank pin formed at an eccentric position on the end of said drive shaft and being inserted into said hole to effect the orbital motion of said orbitting scroll when said drive shaft is rotated, wherein said crank pin has a surface which is curved away from said inner surface of said bushing, a portion of said surface of said crank pin being in contact with a portion of said inner surface of said bushing and another portion of said surface of said crank pin being out of contact with said inner surface of said bushing.

3. In a scroll type compressor including a housing, a fixed scroll fixedly disposed within said housing and having a first circular end plate from which a first spiral wrap extends into the interior of said housing, an orbiting scroll having a second circular end plate from which a second spiral wrap extends, said first and second spiral wraps interfitting at an angular and radial offset to form a plurality of line contacts which define at least one pair of sealed off fluid pockets, a disk shaped bushing rotatably placed in a circular tubular boss formed on a side opposite said second spiral wrap of said orbiting scroll and having a hole defined by inner surfaces of said bushing, a drive shaft supported within said housing through a bearing, and a crank pin formed at an eccentric position on the end of said drive shaft and being inserted into said hole to effect the orbital motion of said orbiting scroll when said drive shaft is rotated, the improvement comprising the end of said crank pin adjacent said drive shaft having a reduced portions such that the edge of said hole adjacent said drive shaft is out of contact with a portion of said crank pin and the reduced portion of the crank pin is curved away from the inner surfaces of the bushing.

4. In the scroll compressor of claim 3 wherein the length of said reduced portion extends to one half the depth of said hole.

5. In the scroll compressor of claim 3 wherein the end of said crank pin opposite said drive shaft has a reduced portion such that the edge of said hole opposite said drive shaft is out of contact with said crank pin.

6. In a scroll type compressor including a housing, a fixed scroll fixedly disposed within said housing and having a first circular end plate from which a first spiral wrap extends into the interior of said housing, an orbiting scroll having a second circular end plate from which a second spiral wrap extends, said first and second spiral wraps interfitting at an angular and radial offset to form a plurality of line contacts which define at least one pair of sealed off fluid pockets, a disk shaped bushing rotatably placed in a circular tubular boss formed on a side opposite said second spiral wrap of said orbiting scroll and having a hole defined by an inner surface of said bushing, a drive shaft supported within said housing through a bearing, and a crank pin formed at an eccentric position on the end of said drive shaft and being inserted into said hole to effect the orbital motion of said orbiting scroll when said drive shaft is rotated, wherein one of said crank pin and said inner surface of said bushing is modified to enable said drive shaft to tilt through a predetermined angle without causing said crank pin to contact an end of said hole adjacent to said drive shaft, wherein said crank pin has a longitudinal axis that is substantially parallel to the longitudinal axis of said drive shaft when the angle between said drive shaft and crank pin is approximately 0°, the surface of said crank pin in contact with the inner surface of the bushing forming at least a point of contact and the portions not in contact with a portion of the inner surface being curved away from the point of contact and towards the longitudinal axis of said crank pin.

7. In a scroll type compressor including a housing, a fixed scroll fixedly disposed within said housing and having a first circular end plate from which a first spiral wrap extends into the interior of said housing, an orbitting scroll having a second circular end plate from which a second spiral wrap extends, said first and second spiral wraps interfitting at an angular and radial offset to form a plurality of line contacts which define at least one pair of sealed off fluid pockets, a disk shaped bushing rotatably placed in a circular tubular boss formed on a side opposite said second spiral wrap of said orbitting scroll and having a hole defined by an inner surface of said bushing, a drive shaft supported within said housing through a bearing, and a crank pin formed at an eccentric position on the end of said drive shaft and being inserted into said hole to effect orbital motion of said orbitting scroll when said drive shaft is rotated, the improvement comprising:

means for enabling said drive shaft to tilt through a predetermined angle without causing said crank pin to contact an end of said hole adjacent to said drive shaft, said means consisting essentially of a crank pin having a modified surface, said modified surface comprising a surface which is curved away from said inner surface of said bushing.

* * * * *